US007665881B2

(12) United States Patent
Elam

(10) Patent No.: US 7,665,881 B2
(45) Date of Patent: Feb. 23, 2010

(54) NIGHT LIGHT AND SPEAKING OBITUARY

(76) Inventor: Phillip Russell Elam, 1709 Pinecrest, Corinth, MS (US) 38834

( * ) Notice: Subject to any disclaimer, the term of this patent is extended or adjusted under 35 U.S.C. 154(b) by 0 days.

(21) Appl. No.: 12/216,930

(22) Filed: Jul. 14, 2008

(65) Prior Publication Data

US 2010/0008076 A1 Jan. 14, 2010

(51) Int. Cl.
*H01R 33/00* (2006.01)

(52) U.S. Cl. ..... 362/641; 362/86; 362/145; 362/183; 362/234; 362/253; 52/133; 40/124.5; 27/1

(58) Field of Classification Search ..... 362/86, 362/145, 183, 234, 253, 641; 52/103, 104, 52/133; 40/124.5; 27/1; 715/717
See application file for complete search history.

(56) References Cited

U.S. PATENT DOCUMENTS 4,169,970 A 10/1979 Opiela et al.
5,014,472 A 5/1991 Svensson
5,404,343 A 4/1995 Boggio
5,729,921 A 3/1998 Rojas
6,132,054 A 10/2000 Rogers et al.
6,414,663 B1 * 7/2002 Manross, Jr. ..... 52/103
6,637,911 B2 10/2003 Sittner
6,761,465 B2 7/2004 Little
6,951,408 B2 10/2005 Stewart
7,089,495 B2 * 8/2006 Barrows ..... 715/717
2001/0036354 A1 11/2001 Majors

* cited by examiner

*Primary Examiner*—Stephen F Husar
(74) *Attorney, Agent, or Firm*—Hoffman, Wasson & Gitler, P.C.

(57) ABSTRACT

A device used in conjunction with a grave marker or headstone for illuminating a grave site during the night. An enclosure unit is directly affixed to the grave marker or provided in a stand alone unit associated with the grave marker. The enclosure also includes audio material, such as an obituary which can be played by depressing or engaging a switch associated with the enclosure. Both the illumination device as well as the audio material are powered by a rechargeable battery connected to a solar panel provided directly on the enclosure.

12 Claims, 10 Drawing Sheets

NIGHT LIGHT AND SPEAKING OBITUARY

FIELD OF THE INVENTION

The present invention is directed to the field of monuments used at a grave site.

BACKGROUND OF THE INVENTION

The death of a loved one, such as a wife, husband, father, mother or a child, is certainly one of the most traumatic experiences in life. After the deceased has been buried, a headstone or other type of marker is erected generally in front of the grave. When the burial is complete and the headstone or the marker is erected, it is important that the remaining family and friends would have a feeling of serenity once the deceased has been laid to rest. Additionally, once the headstone or other marker has been placed in the earth near the deceased, individuals who perhaps did not have the opportunity to attend the burial ceremony, or other individuals who are in the vicinity the headstone or marker would be interested in the type of individual who has been laid to rest. Historically, this type of information about the deceased is provided in a obituary which is printed in one or more newspapers. However, if the people visiting the grave site were unaware of the existence of this obituary, they would not be apprised of any information relating to the deceased with the exception of the deceased's name, the date of the deceased's birth as well as the date of the deceased's death.

A number of prior art patents have been directed to various devices used in conjunction with a headstone or grave marker. For example, U.S. Pat. No. 5,014,472 issued to Svensson discusses a tombstone comprising a casing of weatherproof material, such as stainless steel or aluminum. A storage space is provided in which, preferably a battery operated lamp, is included for illuminating the tombstone as well as the piece of ground in front of the tombstone on suitable occasions. The Svensson patent indicates that the storage space can include small garden tools, vases, etc., which are provided therein. There is no indication of the type of special occasions in which the light would be utilized. It is quite possible that since small garden tools are stored within the storage space, the illumination of the ground in front of the tombstone would be used to allow an individual to eliminate weeds or other unwanted growths when they visited the grave site, even after sundown.

U.S. Pat. No. 6,637,911 issued to Sittner illustrates a grave marker and lighting apparatus including one or more light emitting diodes provided on top of a marker box. A photoconductive cell is provided for illuminating the grave marker after sunset. There is no indication that the grave itself is to be illuminated.

U.S. Pat. No. 4,169,970 issued to Opiela et al discusses an audio reproduction system for use in conjunction with a tombstone. A record/playback unit is adapted to receive a tape cassette therein. A speaker is provided to audibly reproduce a prerecorded message provided on the tape cassette. The prerecorded message would allow an individual to record his or her final farewell for playback at a time of the funeral service or subsequent to the funeral service. A nickel-cadmium battery as well as a solar cell array are utilized to power the audio reproduction system. No mention is made in this patent for illuminating the grave site or utilizing a printed circuit board to store a prerecorded message.

U.S. Pat. No. 5,729,921 issued to Rojas describes a burial marker and display box which can contain audio video recordings which are provided within the marker box. The burial marker box is designed to be buried in the ground and would include a loudspeaker as well as an activator switch for triggering the playback of the audio material.

U.S. Pat. No. 5,404,343 issued to Boggio describes a tombstone provided with an audio system for audibly broadcasting information relating to the buried person. This information may be an epitaph, music, poems, favorite songs, stories, voice messages and the like. The audio system is powered by a battery connected to digital electronic and memory circuits. A further electric panel can be included for charging the battery. A manually operable start switch is connected to the digital electronics and is used to initiate an audio broadcast.

However, none of the aforementioned patents is directed to a system which includes an illumination device for illuminating a portion in front of the headstone or other marker to be used as a night light, allowing the deceased's family and friends a sense of peace and security after sundown. Additionally, no reference is combined with such a night light which will allow an individual visiting the grave site to activate a recording allowing the individual to listen to an obituary or similar statement about the life of the person or persons buried at a certain grave site.

SUMMARY OF THE INVENTION

The deficiencies of the prior art are corrected by the present invention which includes an enclosure unit associated with a headstone or grave marker. The unit would either be directly attached to the headstone, or the grave marker, or would be provided on a separate mounting stand having its bottom portion buried in the ground near the headstone, or grave marker associated with one or two grave sites. The unit would include an illumination device, such as a light emitting diode for illuminating the grave at night. A sensor would be utilized to sense the onset of evening and would illuminate the light emitting diode accordingly.

An analog or digital memory device would be incorporated into the enclosure unit for the purpose of providing an audio output when an appropriate switch has been engaged. The audio output could be, but is not limited to an individual's obituary. The unit would include a device for utilizing solar energy to power both the audio output as well as the light emitting diode. A back-up battery pack could also be provided. Additionally, although the present invention will be described primarily with respect to a single grave stone or marker associated with two graves, it can be appreciated that a single grave stone marker denoting the location of a single deceased individual would also be applicable to this situation. Furthermore, the system of the present invention may be used on a crypt or in a mausoleum where feasible. The enclosure unit may also be used with entrances of cemeteries, churches, funeral homes and the like for announcing funerals or other occasions.

BRIEF DESCRIPTION OF THE DRAWINGS

For a more complete understanding of the present invention and for further advantages thereof, reference is now made to the following examples of embodiments thereof, as shown in the accompanying drawings, in which.

BRIEF DESCRIPTION OF THE PREFERRED EMBODIMENTS

Figure 1:
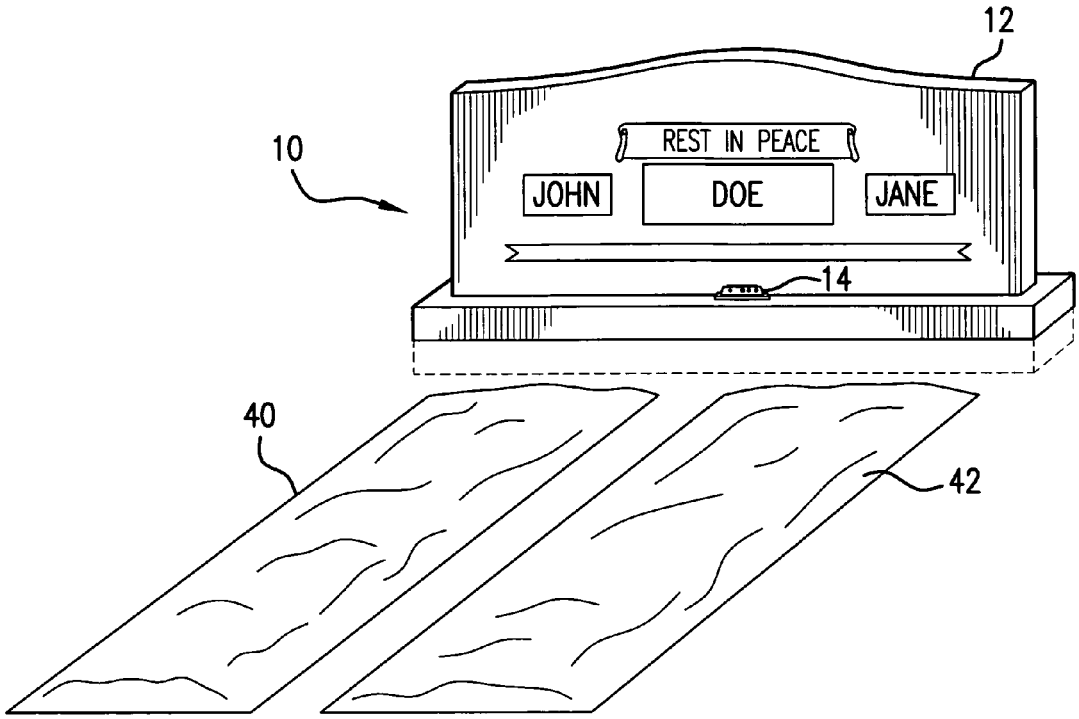
FIG. 1 is a perspective view of one embodiment of the present invention in which an enclosure is mounted to the base of a grave monument associated with two graves.
Figure 1A:
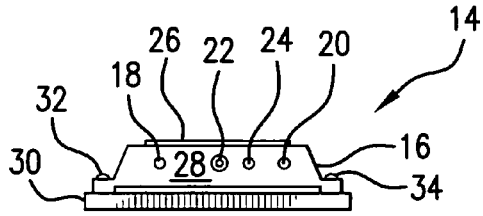
FIG. 1A is an exploded view of the unit 14 shown in FIG. 1.

FIG. 1 illustrates a perspective view of the present invention in which two grave sites 40, 42 are provided with a single headstone 12 containing written information on the front surface relating to the individual buried in grave sites 40 and 42. Although the present invention 10 is depicted with two grave sites, it is understood that the present invention can be utilized with equal facility where there is only one grave site. An enclosure 14, the purpose of which will be subsequently explained, is directly affixed, as illustrated in FIG. 1, to the top of the headstone 12. Alternatively, if a grave marker is buried in the earth in proximity with the grave site or sites, the enclosure would be directly affixed to base 13 of the grave marker. Generally, the enclosure 14 would be constructed of cast bronze or any other material to match the type of stone used for the headstone 12 or grave marker. A solar panel 26 would be affixed to the top of a box like structure 16 of the enclosure 14, and is provided with the appropriate electrical circuits and circuit boards as will be, subsequently, discussed to effectuate the purpose of the present invention. A first light source, such as a light emitting diode 18 would be affixed to the outside 28 of structure 16 or be provided within structure 16. The light emitting diode 18 would be directed to illuminate one of the grave sites, such as 40. A second, similar light emitting diode 20 would be directed toward grave site 42. As can be appreciated, if only a single grave site is associated with the grave marker 12, only one light emitting diode or other illumination device would be utilized, as a night light, to illuminate the single grave site. Similar to light emitting diode 18, light emitting diode 20 would be directly affixed to the outside of the structure 16 or situated within the structure 16. If light emitted by diodes 18, 20 were provided within the structure 16, appropriate holes would be provided to project light from the interior of structure 16 to the respective grave sites 40, 42.

As will be explained hereinbelow, structure 16 would be provided therein with a first circuit board or similar device in which the solar panel 26 would be utilized to power one or both of the light emitting diodes 18, 20 at the appropriate time. Additionally, a second circuit board or similar device, acting as a memory device, would be provided within structure 16 to provide an audio response such as an obituary which would be presented when an individual would activate or engage any type of switch 22 provided on the exterior of structure 16. A mounting plate 30 constructed from bronze or similar material would be attached to the unit assembly 16 through the use of screw 32 and hole 38 as well as screw 34 and hole 36 shown in FIGS. 1, 7 and 8. Although two screws are shown, it can be appreciated that a plurality of screws can be utilized for this purpose. The mounting plate 30 is directly attached to the base 13 of the grave stone 12.

Additionally, it is noted that when this device is associated with a grave marker for two individuals, the switch 22 would be pressed a second time, if so programmed, to present an audio output for the second individual. The switch would be used to access separate portions of the memory, or alternatively, a second memory device could be employed. Alternatively, a second switch may be deployed.

Figure 2:
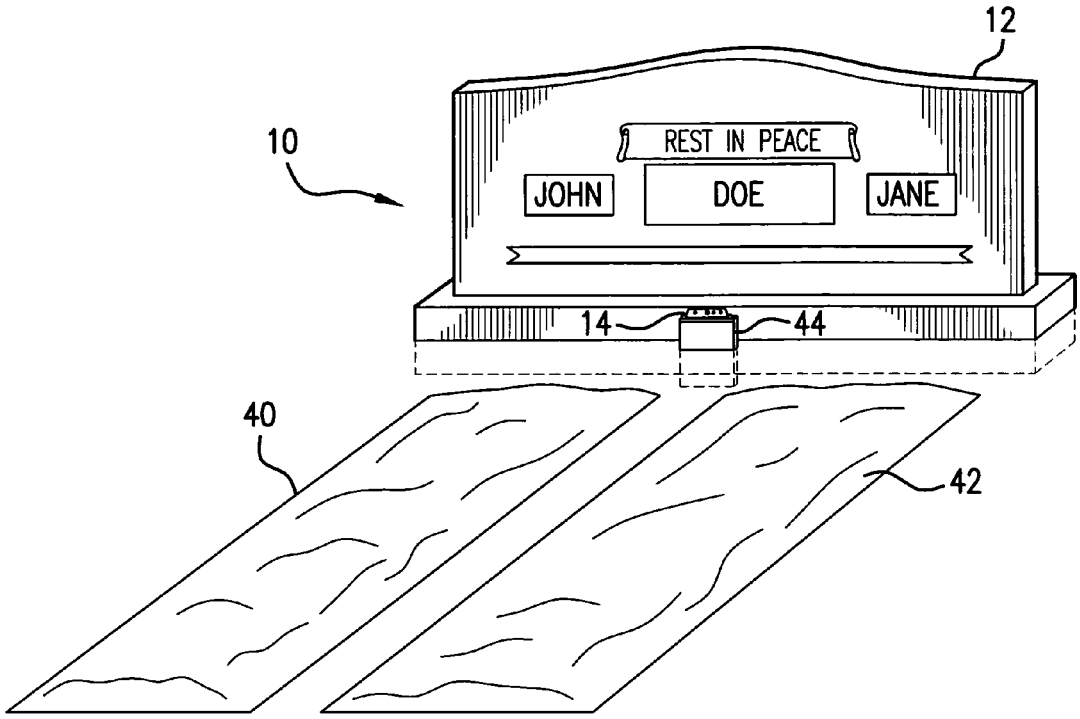
FIG. 2 is a perspective view of a second embodiment of the present invention in which the enclosure is buried in front of a grave monument.
Figure 2A:
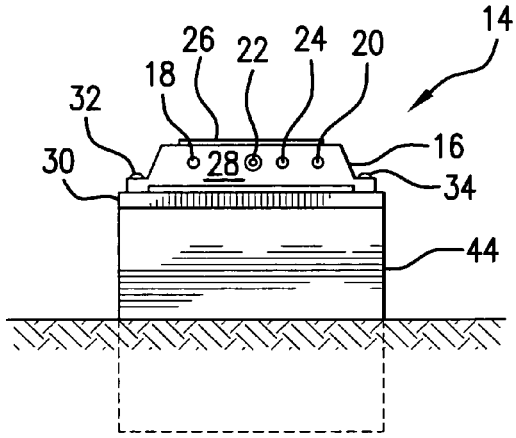
FIG. 2A is an exploded view of the unit 14 shown in FIG. 2.

FIG. 2 illustrates a second embodiment of the present invention showing the enclosure unit 14 associated with two grave sites 40 and 42 and a grave stone 12. In this embodiment, the enclosure 14 is affixed to the top of a mounting stand 44 to be buried in the earth between the grave stone 12 and the grave sites 40 and 42. The mounting plate 30 can be directly affixed to the mounting stand 44, or, alternatively, the enclosed unit 14 and the mounting stand 44 can be constructed as a single unit. The mounting stand 44 is to be constructed from any type of sturdy material, such as stone, bronze or the like which would not deteriorate when buried in the ground. The enclosure unit 14 depicted in FIG. 2 as well as shown in FIGS. 3-6 is similar to the enclosure unit 14 described with respect to FIG. 1. The operation of the closure unit 14 as shown in FIGS. 2-6 would be the same as the operation of the enclosure unit 14 described with respect to FIG. 1 and will not be repeated.

Figure 3:
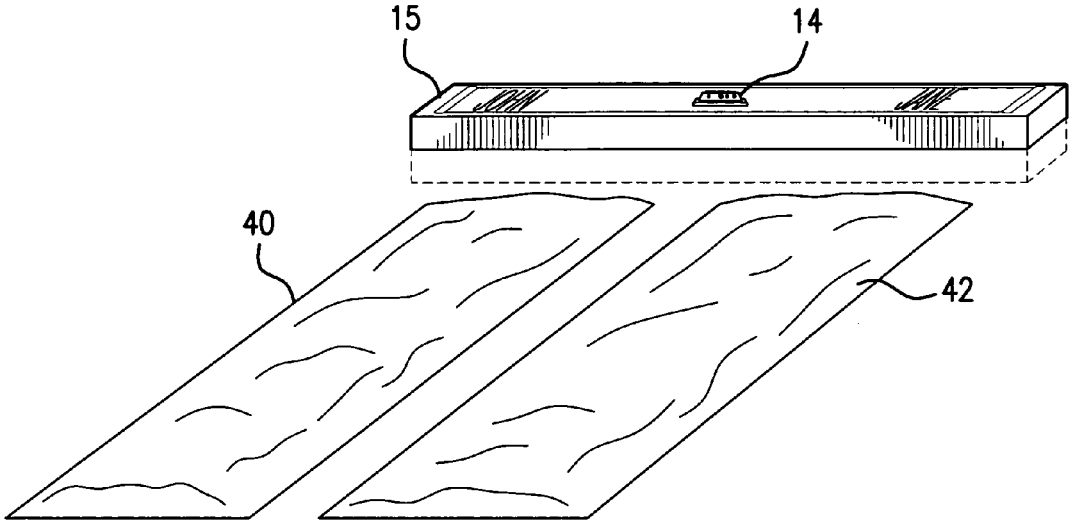
FIG. 3 is a perspective view of a third embodiment of the present invention in which the enclosure is mounted on top of a grave marker.
Figure 3A:
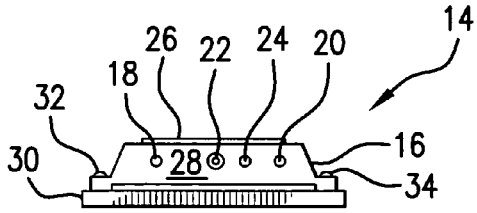
FIG. 3A is an exploded view of the unit 14 shown in FIG. 3.

FIG. 3 illustrates an embodiment of the present invention in which the enclosure unit 14 is directly affixed to the top of a grave marker 15. Similar to the embodiment shown with respect to FIG. 1, mounting plate 30 would be affixed to the top of the grave marker 15 utilizing screws 32 and 34. Similar to the description with respect to FIG. 1, more than two screws could be used to affix the enclosure 14 to the top of the grave marker 15.

Figure 4:
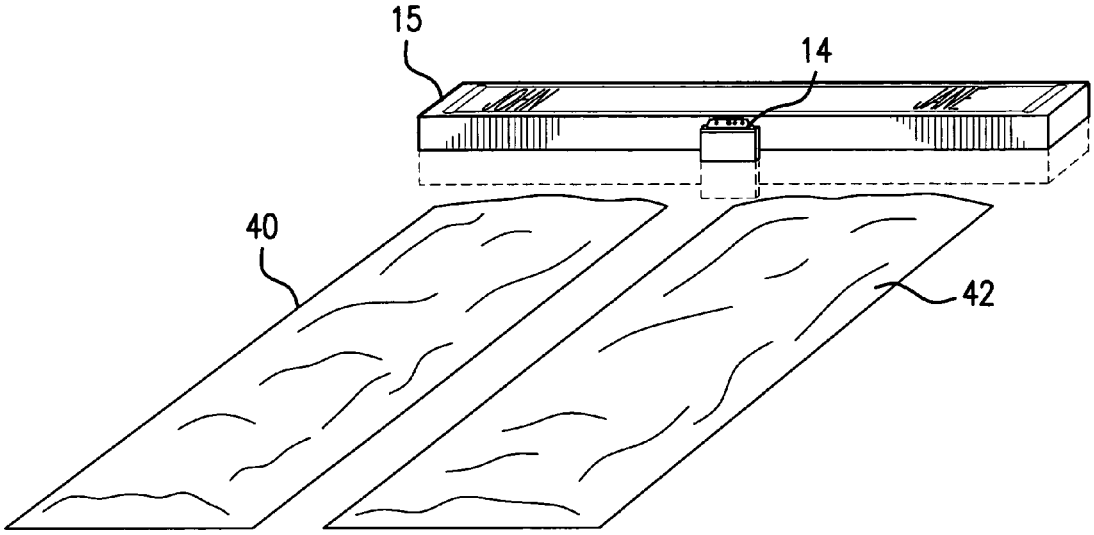
FIG. 4 is a perspective view of the enclosure mounted in front of the grave marker.
Figure 4A:
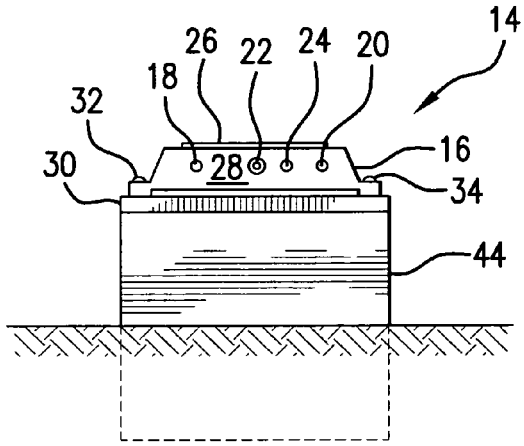
FIG. 4A is an exploded view of the unit 14 shown in FIG. 4.

FIG. 4 illustrates an embodiment in which the enclosure unit 14 is affixed to a mounting stand 44 similar in nature to the embodiment described with respect to FIG. 2. In the embodiment shown in FIG. 4, the enclosure unit 14-mounting stand unit 44 combination would be buried between the grave marker 15 and the grave sites 40 and 42.

Figure 5:
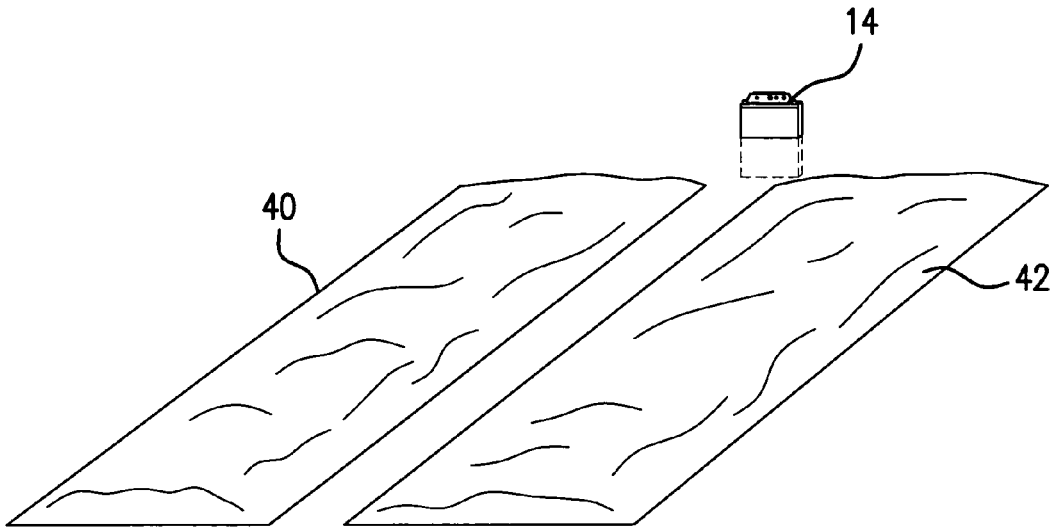
FIG. 5 is a perspective view of the enclosure buried in front of two graves.
Figure 5A:
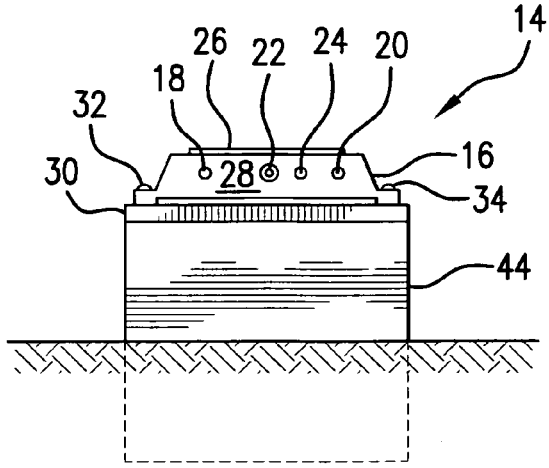
FIG. 5A is an exploded view of the unit 14 shown in FIG. 5.

FIG. 5 shows an embodiment in which the enclosure unit 14-mounting stand 44 combination as described with respect to FIGS. 2 and 4 are buried in the ground in front of grave sites 40 and 42 which do not have a grave stone or marker associated with the grave site 40 and 42.

Figure 6:
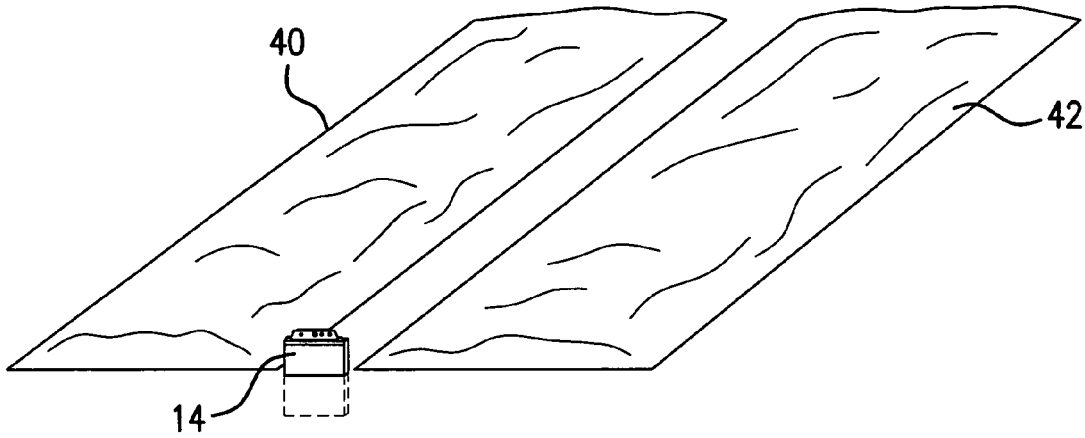
FIG. 6 is a perspective view of the enclosure buried at the foot of the two graves.
Figure 6A:
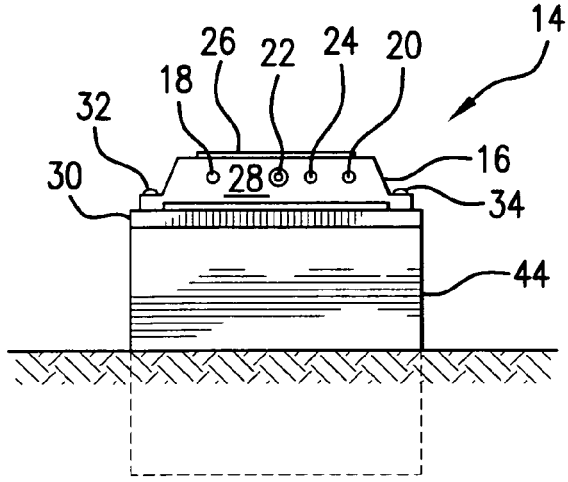
FIG. 6A is an exploded view of the unit 14 shown in FIG. 6.

FIG. 6 illustrates an embodiment in which the enclosure unit 14-mounting stand combination 44 is buried in the ground at the foot of the grave of the grave site 40 and 42.

Figure 7:
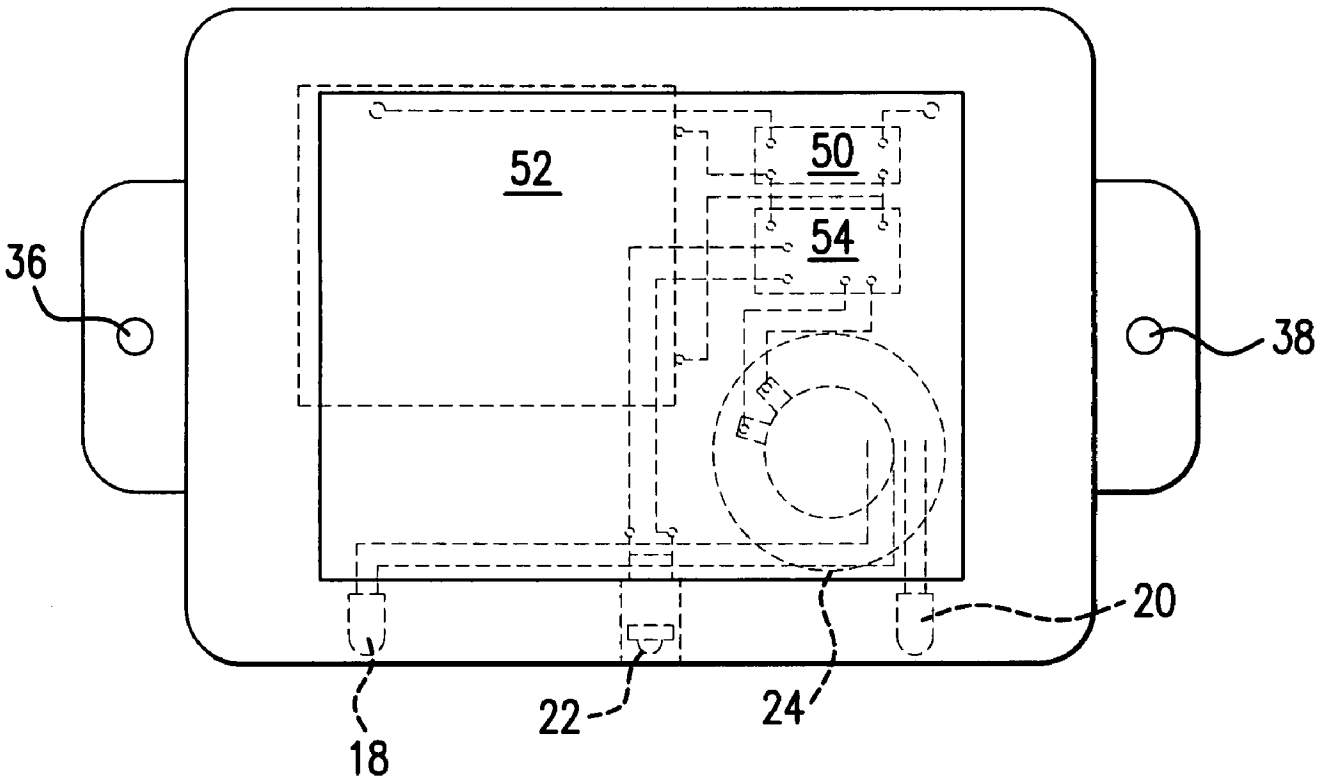
FIG. 7 is a top view of the enclosure including a night light and audio unit.
Figure 8:
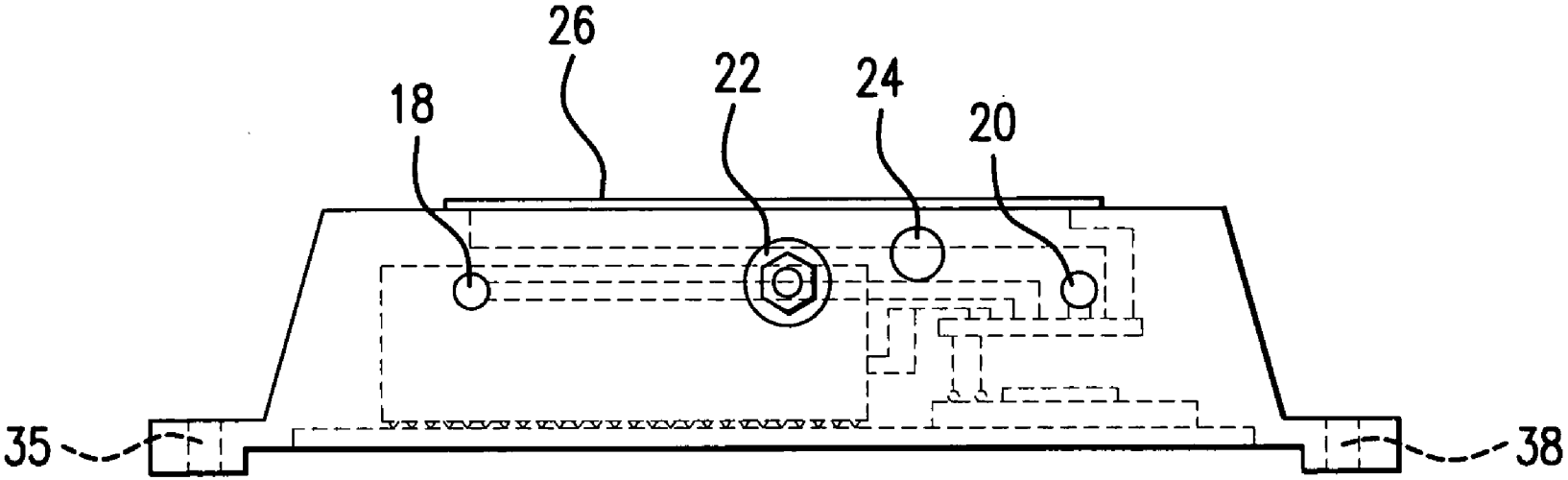
FIG. 8 is a front view of the unit shown in FIG. 3.

FIGS. 7 and 8 depict the enclosure unit 14 shown in FIGS. 1-6. Circuits are provided therein for operating the present invention. These circuits include a circuit board 50 for powering the light emitting diodes 18, 20 as well as an integrated circuit or circuit board 54 for providing the audio output through a suitable speaker 24, projecting out of the structure 16. A battery pack 52 is used in conjunction with the solar panel 26 to power both the illumination of the light emitting diodes 18, 20 as well as the speaker 24. Although any type of battery pack can be utilized, the present invention has been determined to work particularly well using a 4.8 VDC and NIMH rechargeable battery pack.

Figure 9:
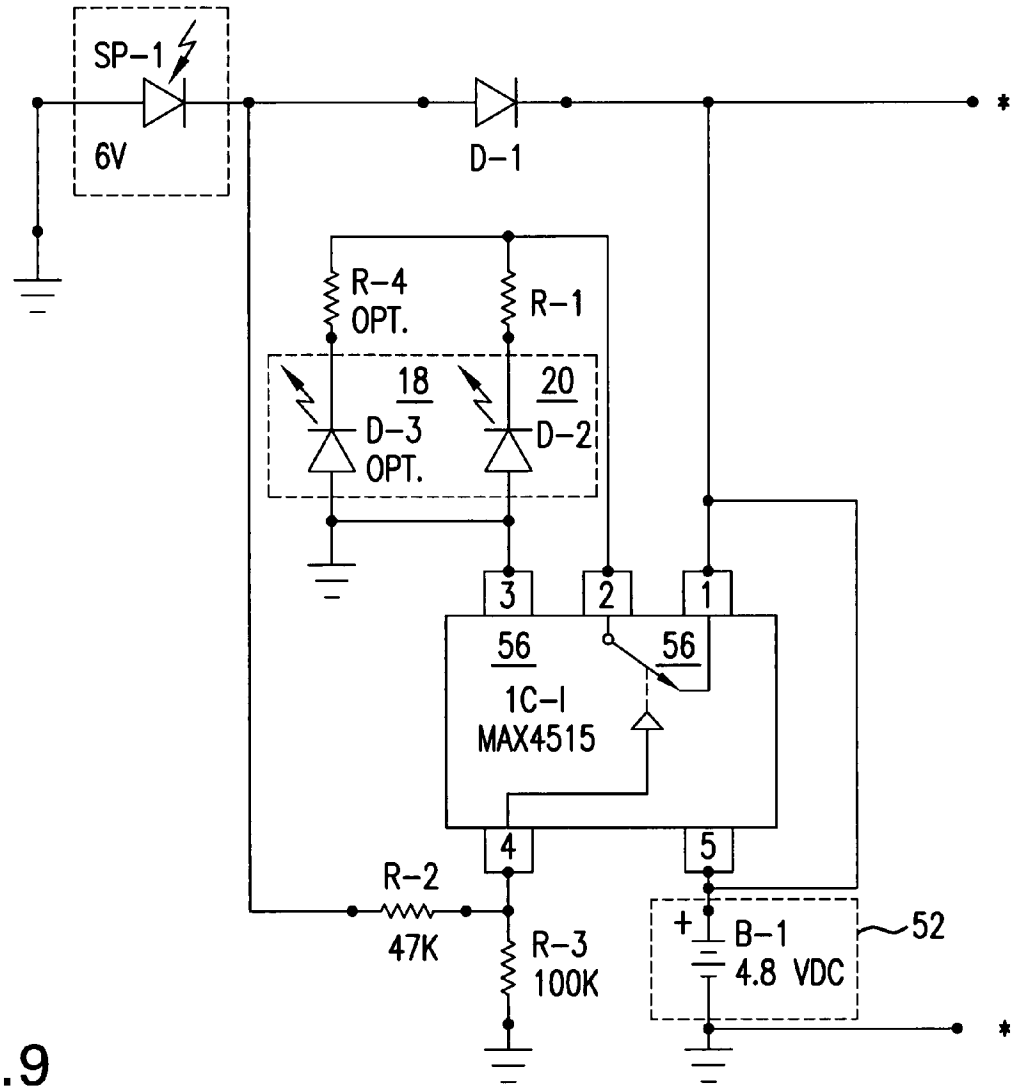
FIG. 9 is a wiring diagram of the night light powered by a solar unit.

FIG. 9 is a circuit diagram showing the manner in which the elements within the enclosure 14 are to be powered. Solar panel Sp-1 produces a 6 volt DC output when the sun's rays are impinging upon the panel 26. This 6 volt output is applied to the anode side of diode D-1 as well as to pin 1 of integrated circuit 50 provided with a normally closed switch 56. The circuit can be, but does not necessarily have to be CMOS analog integrated circuit. The voltage transmitted from diode D-1 is also applied to pin 5 of IC circuit 50 as well as at the positive pole of the battery pack 52. Therefore, when sunlight strikes the solar panel 26, current begins to flow into the battery to recharge it to its full status. The battery pack is grounded on the negative pole to complete the circuit. Since the output pin of the diode D-1 is connected to pin 1 of circuit 50, voltage is available to the internal switch 56 of integrated circuit 50 to power the light emitting diodes 18, 20 on the cathode terminals through the use of current limiting resistors R-1 and R-4 when no sunlight impinges, upon the solar panel 26. The anode terminals of the light emitting diodes 18, 20 are connected to pin 3 of the circuit 50 as well as the ground to complete the circuit.

The output voltage of the solar panel determines if current flows through resistor R-2 to pin 4 of the circuit 50. When there is no sunshine, such as at night, there will be no voltage output from the solar panel and therefore no current flow into the resistor R-2 and consequently into pin 4 of circuit 50. Therefore, as shown in FIG. 9, switch 56 is normally closed and will remain closed and a voltage would be applied to both of the light emitting diodes 18, 20 through resistors R-1 and R-4, since switch 56 is in the closed position. In this manner, when there is no sunshine, the light emitting diodes 18, 20 would illuminate one or both of the grave sites. The intensity of the light emitted from the light emitting diodes would depend on the voltage value as well as the values of resistors R-1 and R-4.

When the solar array senses sunlight, a voltage is generated which reverses the above-described procedure resulting in the switch moving from the closed position 56 as shown in FIG. 9, connecting pins 1 and 2 together, to an open position. Therefore the light emitting diodes would not be illuminated and the voltage produced by the solar panel would be used to recharge the battery pack 52. In this manner, no voltage would be applied to pin 2 of the circuit 50.

Figure 10:
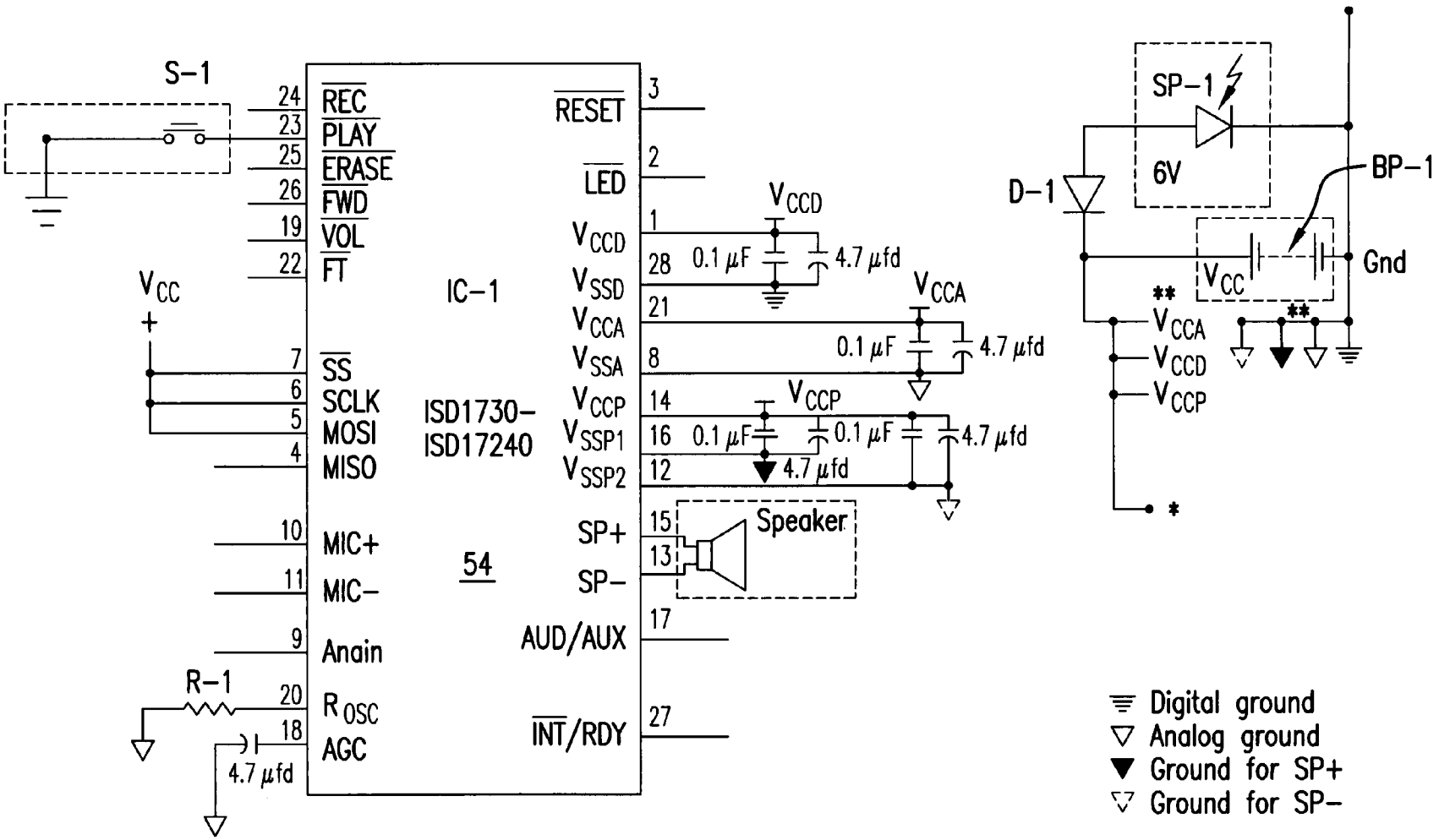
FIG. 10 is a diagram of a printed circuit used to provide an audio output.

FIG. 10 describes an integrated circuit 54 used to provide an audio output. This integrated circuit is provided within the enclosure 14 and is to be powered by the same solar panel/battery pack combination that powers the illumination of the light emitting diodes 18, 20. The circuit 54 has a memory chip, such as a flash memory, therein into which an audio recording is stored in analog form. Although a digital memory can be employed, it is noted that the analog form has a better sound quality and would allow more information to be stored therein with less memory. Generally, the audio information would be recorded prior to the enclosure 14 being assembled at a factory or other site. The chip is capable of holding a message for up to approximately 100 years without additional power. Furthermore, the unit of the present invention would be able to illuminate the grave or grave sites for approximately 20 days without any sunlight. Based upon the amount of memory provided within the integrated circuit 54, the present invention contemplates at least a message having a duration of eight minutes. However, this time can be shortened or lengthened accordingly. The battery pack shown in FIG. 9 is directly connected to pins 1, 14 and 21 of the circuit 54. The battery pack is grounded at pins 8, 12, 16 and 28. 0.1 microfarad capacitors are connected from pin 1 to pin 28, from pin 21 to pin 8 and from pin 14 to pin 16 as well as from pin 14 to pin 12. The purpose of these capacitors is for decoupling of high frequencies from the battery pack 52.

Additionally, 4.7 microfarad capacitors are connected from pin 1 to pin 28, from pin 21 to pin 8, from pin 14 to pin 12 as well as from pin 14 to pin 16. The purpose of these capacitors is for filtering the alternating current content of the rectified power supplies. Although it is indicated that 0.1 microfarad and 4.7 microfarad capacitors are employed, it is noted that the exact measure of these capacitors are not crucial to the present invention.

Pins 13 and 15 are the outputs of the internal audio power amplifier producing approximately 670 mw of power into an external speaker 24 with a voltage of approximately 5.5 volts DC.

Pin 18 is connected to the automatic gain control for adjusting the gain of the input the microphone input level to obtain a full range of signals when the message is recorded at a minimal distortion. Pin 20 is connected to a resistor to determine the sampling frequency of the chip which sets the duration of the time and quality of the recorded message. The input of the microphone when the message is initially recorded is connected to pins 10 and 11. Pin 5, pin 6 and pin 7 when not used are to be connected to the positive terminal of the power supply. Pin 23 is shunted to ground through switch 22 (S-1) to initiate the playback of the message. As previously indicated, this switch is generally provided on the exterior surface of the enclosure 14.

All the other pins are used for factory pre-use functions, such as recording a message or messages, erasing messages, presetting the volume control, reset, etc. and are not used once the unit is provided in the field.

The recordings are stored in the on-chip flash memory cell providing zero power message storage. Audio data is stored directly into the solid state memory of the circuit 54 without digital compression. The information is stored in analog form whereas the prior art references store their information in a digital form.

One skilled in the art will appreciate that the present invention is not limited to the embodiments described in the accompanying drawings and the foregoing detailed description which can be presented for purposes of illustration only, but can be implemented in a number of ways and is defined by the following claims.

What is claimed is:

1. A night light and audio information device located at a grave site marking the resting place of an at least one individual comprising;

a light source directed at the resting place of at least one individual, said light source illuminating said resting place;

said light source comprising a first light emitting diode illuminating the resting place of one individual and a second light emitting diode illuminating the resting place of a second individual;

a power source in connection with said light source providing electricity to power said light source;

a memory device for storing information relating to the at least one individual;

an audio device connected to said memory device for playing the information stored in said memory device; and an enclosure for storing said power source, said memory device and said audio device therein.

2. The night light and audio information device in accordance with claim 1, wherein a headstone or grave marker is provided in proximity of the grave site and wherein said enclosure is positively affixed to the headstone or grave marker.

3. The night light and audio information device in accordance with claim 1, wherein a headstone or grave marker is provided in proximity with the grave site, and further including a base structure, said enclosure affixed to said base structure, and wherein a portion of said base structures is buried in the ground near the headstone or grave marker.

4. The night light and audio information device in accordance with claim 2, further including at least one solar cell in connection with said light source and said power source, said solar cell affixed to said enclosure.

5. The night light and audio information device in accordance with claim 3 further including at least one solar cell in connection with said light source and said power source, said solar cell affixed to said enclosure.

6. The night light and audio information device in accordance with claim 4, wherein said power source is a rechargeable battery and further including circuitry provided between said solar cell, said light source and said battery for recharging said battery which light rays strike said solar cell, and for illuminating the resting place through the use of said light source when light rays do not strike said solar cell.

7. The night light and audio information device in accordance with claim 5 wherein said power source is a rechargeable battery and further including circuitry between said solar cell, said light source and said battery for recharging said battery which light rays strike said solar cell, and for illuminating the resting place through the use of said light source when light rays do not strike said solar cell.

8. The night light and audio information device in accordance with claim 1, further including a first switch affixed to said enclosure and in communication with said memory device, for activating said memory device to provide audio information relating to a first individual.

9. The night light and audio information device in accordance with claim 8, wherein said audio information is stored in analog form.

10. The night light and audio information device in accordance with claim 1, wherein said light source is a light emitting device.

11. The night light and audio information device in accordance with claim 8, provided with a second switch affixed to said enclosure and in communication with said memory device to provide audio information about the second individual, said second switch connected to said memory device and said audio device.

12. The night light and audio information device in accordance with claim 1, further including a base structure, said enclosure affixed to said base structure, and wherein a portion of said base structures is buried in the ground near the base of the grave site.

* * * * *